US009828219B2

(12) United States Patent
Casassa et al.

(10) Patent No.: US 9,828,219 B2
(45) Date of Patent: Nov. 28, 2017

(54) BOOM TELESCOPE SYNCHRONIZING AND SEQUENCING CONTROL

(71) Applicant: Tadano Mantis Corporation, Franklin, TN (US)

(72) Inventors: Tony Casassa, Franklin, TN (US); Reagan Bull, Spring Hill, TN (US); Daniel Denney, College Grove, TN (US)

(73) Assignee: TADANO MANTIS CORPORATION, Franklin, TN (US)

( * ) Notice: Subject to any disclaimer, the term of this patent is extended or adjusted under 35 U.S.C. 154(b) by 868 days.

(21) Appl. No.: 14/193,675

(22) Filed: Feb. 28, 2014

(65) Prior Publication Data

US 2015/0246794 A1 Sep. 3, 2015

(51) Int. Cl.

| | |
|---|---|
| ***F15B 15/16*** | (2006.01) |
| ***B66C 23/70*** | (2006.01) |
| *F15B 15/20* | (2006.01) |
| *F15B 15/28* | (2006.01) |

(52) U.S. Cl.

CPC ..... *B66C 23/705* (2013.01); *F15B 15/165* (2013.01); *F15B 15/202* (2013.01); *F15B 15/2807* (2013.01)

(58) Field of Classification Search

CPC .... B25J 18/025; B66C 23/705; B66C 23/701; F15B 15/165

See application file for complete search history.

(56) References Cited

U.S. PATENT DOCUMENTS 4,125,974 A * 11/1978 Kay ..... B66C 23/705 212/289
5,645,181 A * 7/1997 Ichiba ..... B66C 23/90 212/281
2004/0262078 A1* 12/2004 Bailey ..... B66F 17/006 182/2.1

* cited by examiner

*Primary Examiner* — Logan Kraft
*Assistant Examiner* — Abiy Teka
(74) *Attorney, Agent, or Firm* — Procopio, Cory, Hargreaves & Savitch LLP

(57) ABSTRACT

An extension boom system for heavy equipment having, the extension boom system including a first actuator mounted on a base, and connecting a second stage, a second actuator mounted on the second stage and connecting the second stage to a third stage, a third actuator mounted on the third stage and connecting the third stage to an extendable portion, and a controller configured to control the first actuator, the second actuator, and the third actuator so as to selectively operate in a first operation mode and a second operation mode. In the first operation mode, the first actuator, the second actuator, and the third actuator are operated substantially simultaneously, and wherein in the second operation mode, two of the first actuator, the second actuator, and the third actuator are actuated substantially simultaneously, while another of the first actuator, the second actuator, and the third actuator is not actuated.

16 Claims, 13 Drawing Sheets

BOOM TELESCOPE SYNCHRONIZING AND SEQUENCING CONTROL

FIELD

The present disclosure relates generally to construction equipment and other heavy machinery having a telescoping boom, and more specifically, heavy machinery that may operate the telescoping boom in multiple modes.

RELATED ART

Related art construction equipment, or other heavy equipment, sometimes has a boom, such as a telescoping boom, having multiple extendable sections. Such equipment has traditionally only been operable in a single operation mode in which each of the extendable sections is extended sequentially. However, in certain operational situations, a drop in boom strength or structural integrity can occur when a single stage is fully extended prior to other stages being extended. Thus, some more recently developed related art equipment has a second operational mode that allows two or more sections to be extended simultaneously.

Related art solutions for achieving multiple modes require large hose reels to operate multiple sections simultaneously. These related art hose reels are limited in flow and pressure at levels that are below the requirements for large scale equipment, such as large cranes. Further, there is no acceptable custom hose reel, because a custom hose reel to accept the size and pressure rating required of hoses for large scale crane operations would be very large, and space for such reels is not available in related art boom designs.

Additionally, related art equipment does not provide real time feedback to an operator with respect to a degree of extension or retraction and instead rely on an operator to visually estimate based on physical appearance. Further, such estimations may require a second worker located outside of an operator cabin, and be relayed by hand signal or radio communication. Reliance on visual estimations by the operator or second worker outside the cabin can increase the risk of injury associated with the operation of the equipment. Further, requiring a second worker to visually estimate the length of extension or retraction of the sections can increase the operational costs associated with the equipment.

SUMMARY

A first example implementation may include an extension boom system for heavy equipment having a base, the extension boom system including a first actuator mounted on the base, and connecting the base to a second stage, a second actuator mounted on the second stage and connecting the second stage to a third stage, a third actuator mounted on the third stage and connecting the third stage to an extendable portion, and a controller configured to control the first actuator, the second actuator, and the third actuator so as to selectively operate in a first operation mode and a second operation mode, wherein in the first operation mode, the first actuator, the second actuator, and the third actuator are operated substantially simultaneously, and wherein in the second operation mode, two of the first actuator, the second actuator, and the third actuator are actuated substantially simultaneously, while another of the first actuator, the second actuator, and the third actuator is not actuated.

Another example implementation may include a piece of heavy equipment including a base, an extendable structure, an extension boom system connecting the base structure to the extendable structure, the extension boom system comprising, a first actuator mounted on the base, and connecting the base to a second stage, a second actuator mounted on the second stage and connecting the second stage to a third stage, a third actuator mounted on the third stage and connecting the third stage to an extendable structure, and a controller configured to control the first actuator, the second actuator, and the third actuator to as to selectively operate in a first operation mode and a second operation mode, wherein in the first operation mode, the first actuator, the second actuator, and the third actuator are operated substantially simultaneously, and wherein in the second operation mode, two of the first actuator, the second actuator, and the third actuator are actuated substantially simultaneously, while another of the first actuator, the second actuator, and the third actuator is not actuated.

Another example implementation may include A method for controlling an extension boom system including a first actuator connecting to a secondary stage, a second actuator mounted on the secondary stage and connecting to a tertiary stage, and a third actuator mounted on the tertiary stage and connecting to an extendable portion, the method including selecting one of a first operation mode and a second operation mode, when the first operation mode is selected, actuating each of the first actuator, the second actuator, and the third actuator substantially simultaneously to extend or retract the extension boom system, and when the second operation mode is selected, actuating only two of the first actuator, the second actuator, and the third actuator simultaneously, after the two of the first actuator mechanism, the second actuator mechanism, and the third actuator mechanism are actuated simultaneously, actuating only the other of the first actuator mechanism, the second actuator mechanism, and the third actuator mechanism.

BRIEF DESCRIPTION OF THE DRAWINGS

One or more example implementations will now be described with reference to the drawings. The drawings and the associated descriptions are provided to illustrate example implementations of the disclosure and not to limit the scope of the disclosure. Throughout the drawings, reference numbers are maintained to indicate correspondence between referenced elements.

DETAILED DESCRIPTION

The subject matter described herein is taught by way of example implementations. Various details have been omitted for the sake of clarity and to avoid obscuring the subject matter. The examples shown below are directed to structures and processes for implementing Boom Telescope Synchronizing & Sequencing Control.

Heavy Equipment and Boom Extension System

Figure 1:
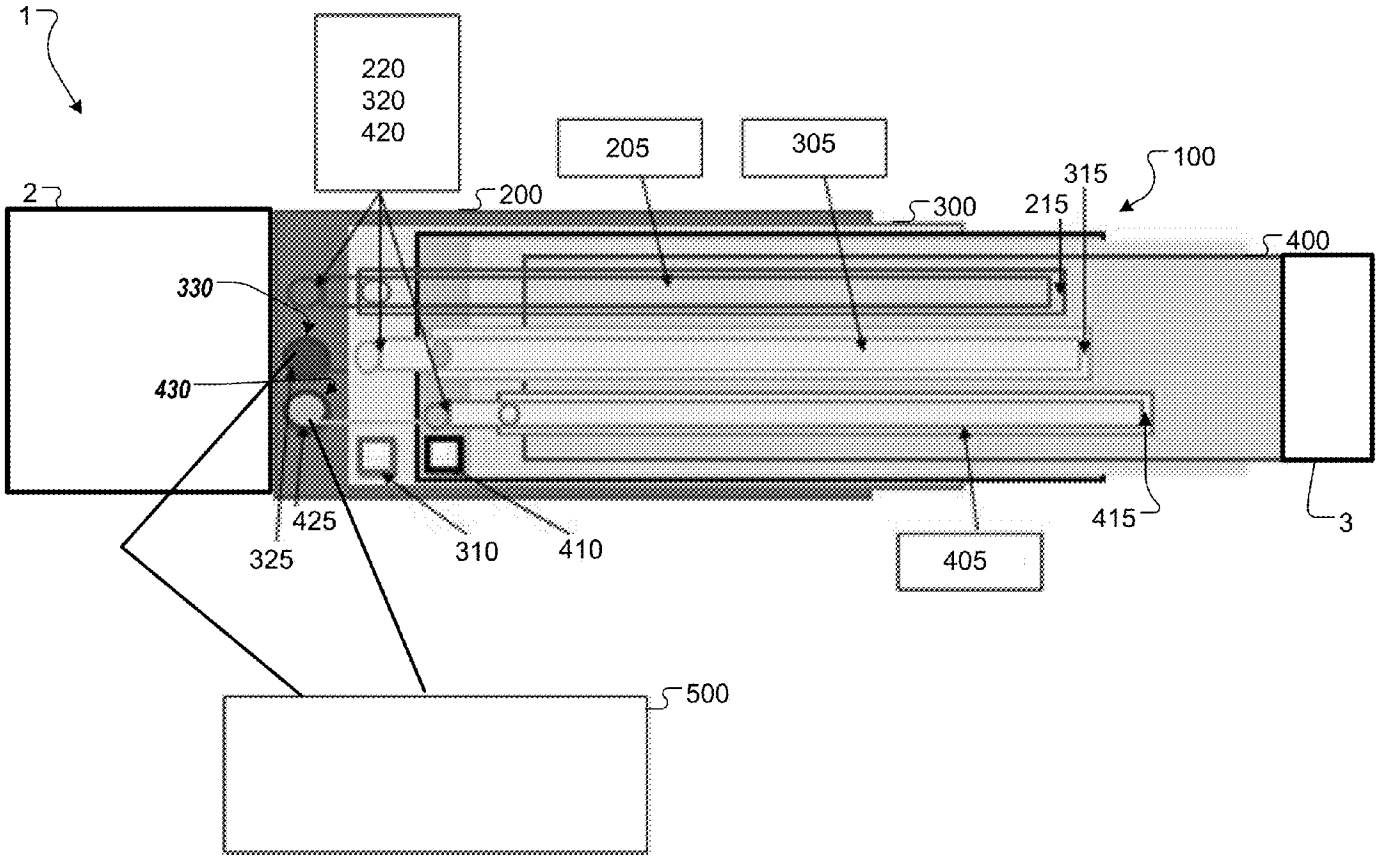
FIG. 1 is schematic view of a boom extension system according to an example implementation.
Figure 3:
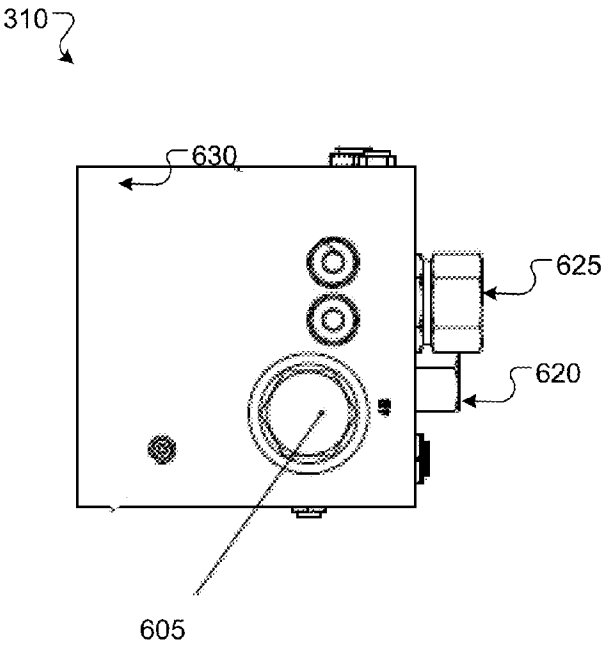
FIG. 3 is a top view of the first valve manifold used in a boom extension system according to the example implementation.
Figure 2:
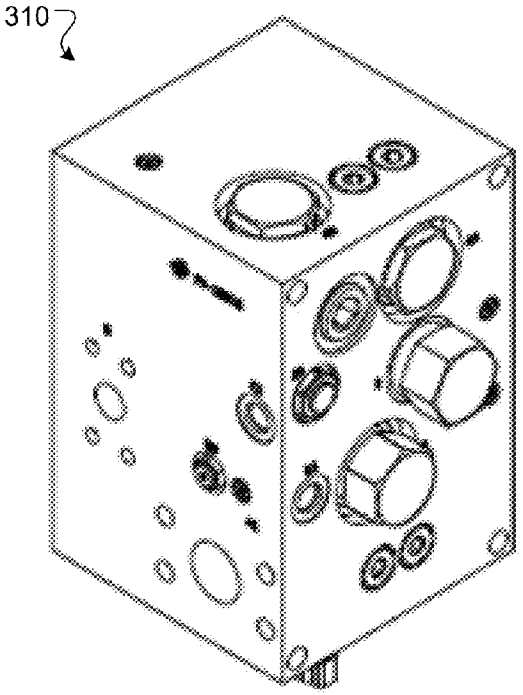
FIG. 2 is a perspective view of a first valve manifold used in a boom extension system according to the example implementation.
Figure 5:
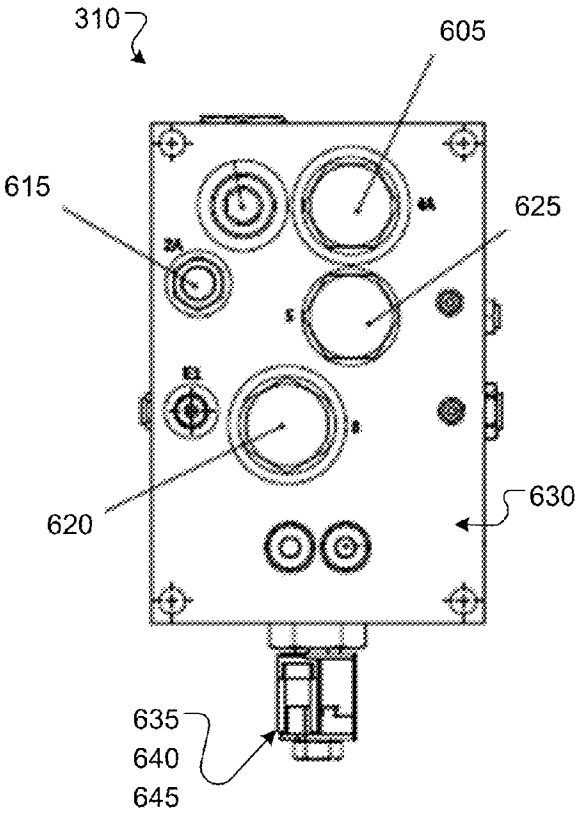
FIG. 5 is a second side view of the first valve manifold used in a boom extension system according to the example implementation.
Figure 4:
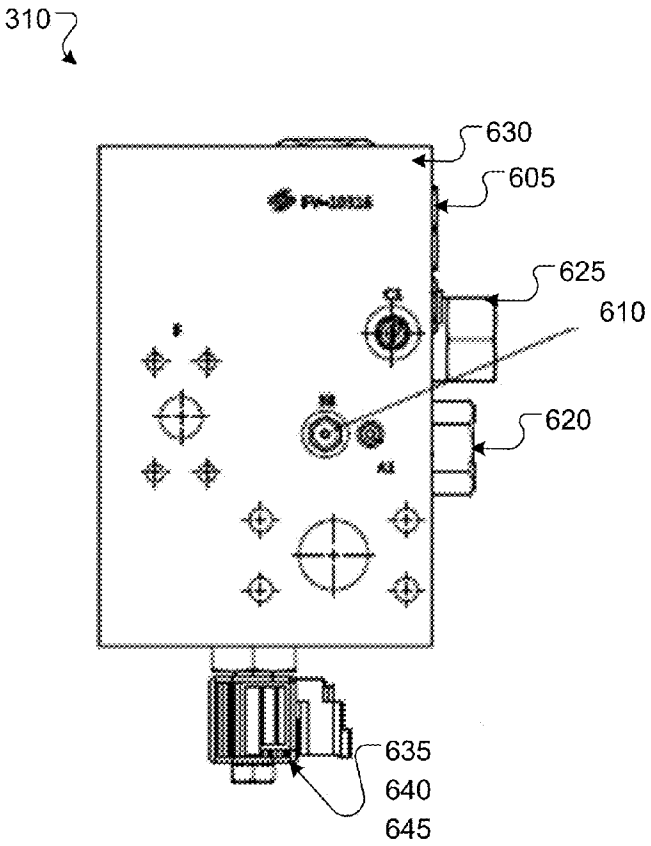
FIG. 4 is a first side view of the first valve manifold used in a boom extension system according to the example implementation.
Figure 7:
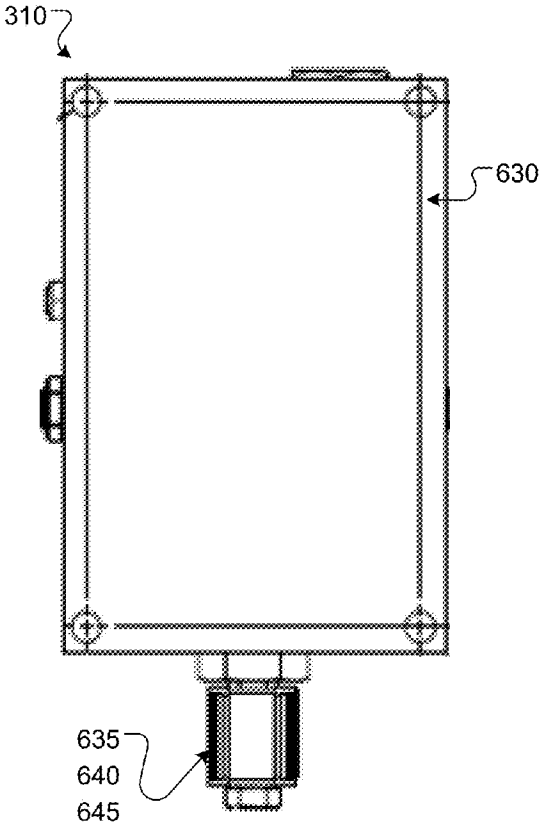
FIG. 7 is a fourth side view of the first valve manifold used in a boom extension system according to the example implementation.
Figure 6:
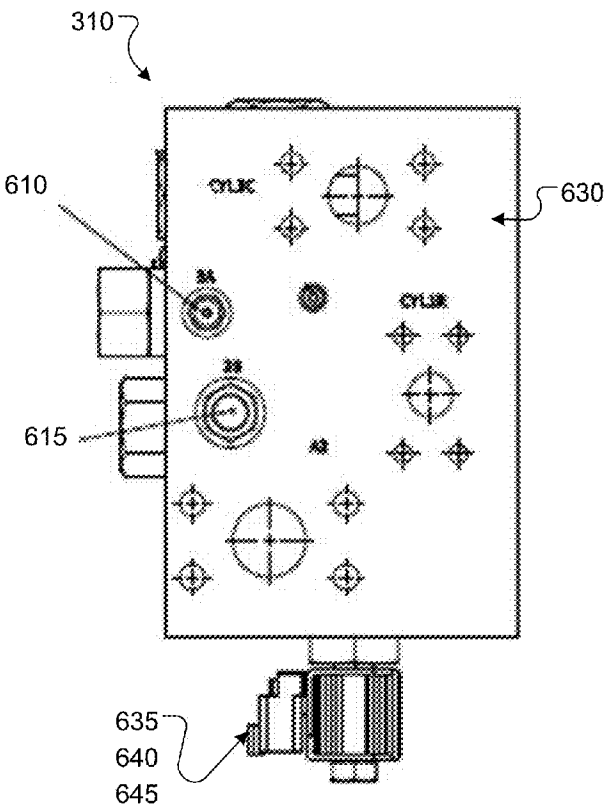
FIG. 6 is a third side view of the first valve manifold used in a boom extension system according to the example implementation.
Figure 8:
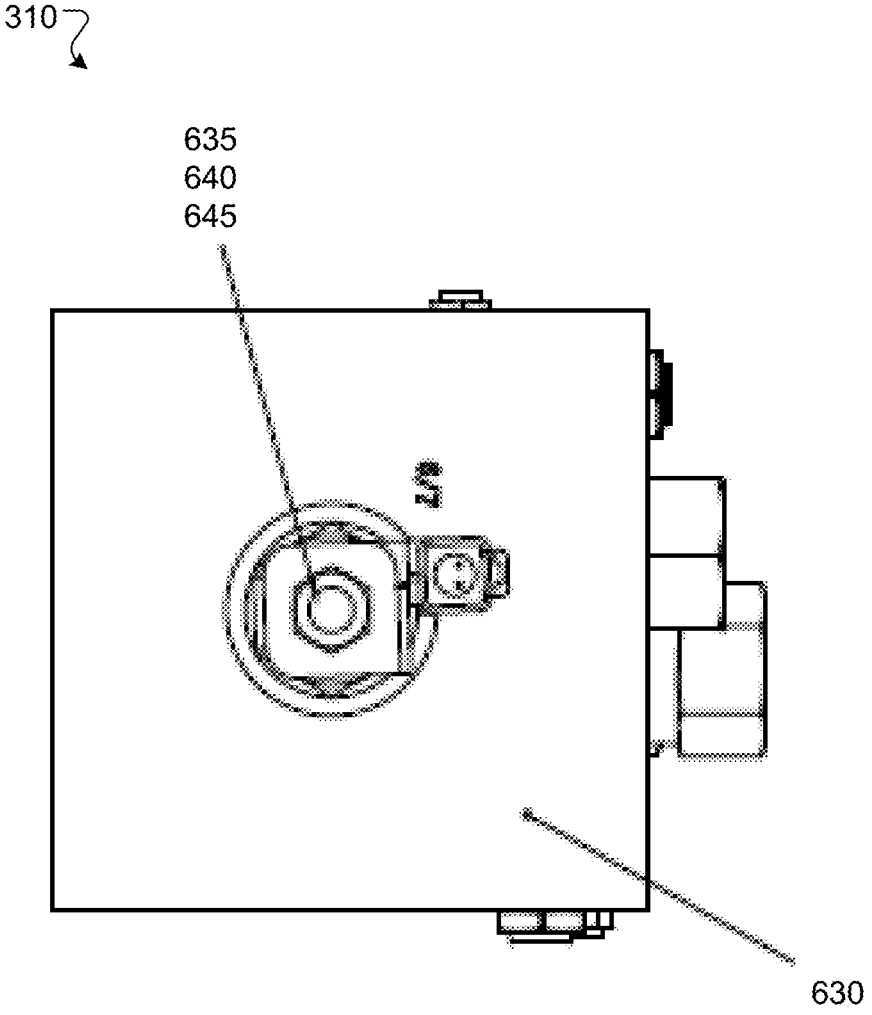
FIG. 8 is a bottom view of the first valve manifold used in a boom extension system according to the example implementation.
Figure 10:
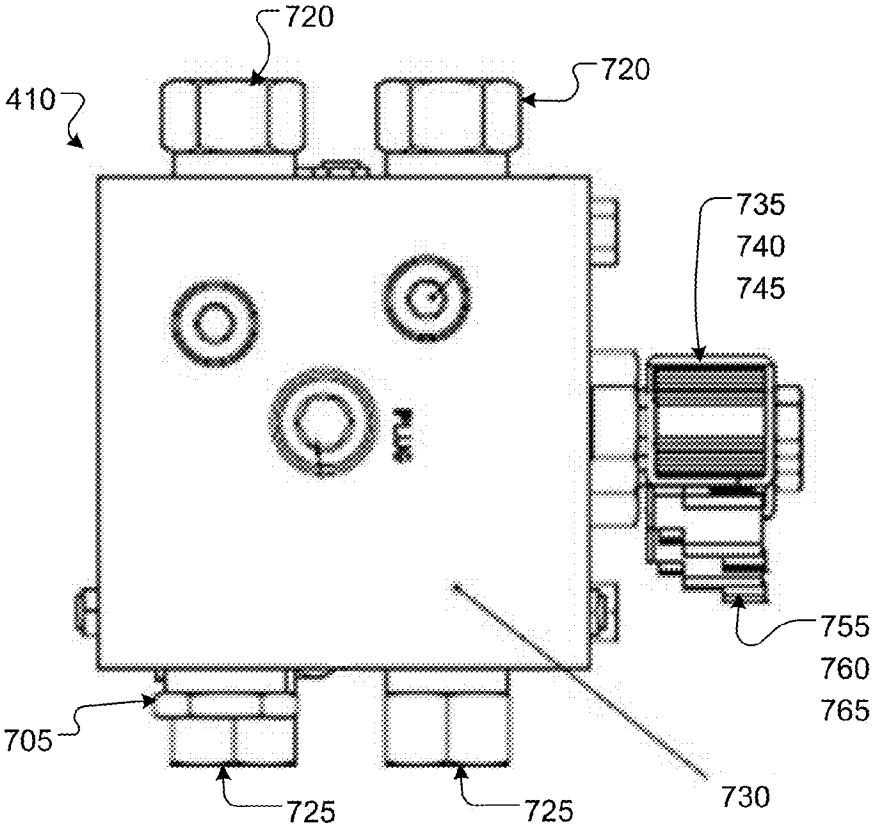
FIG. 10 is a top view of the second valve manifold used in a boom extension system according to the example implementation.
Figure 9:
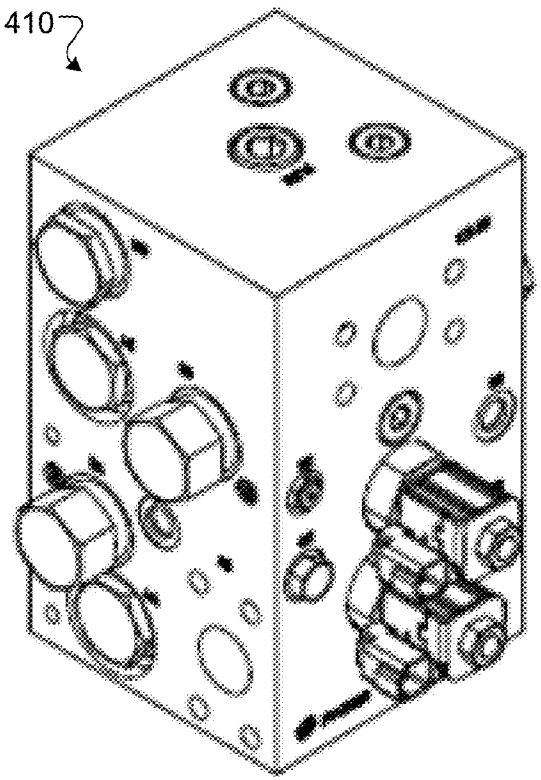
FIG. 9 is a perspective view of a second valve manifold used in a boom extension system according to the example implementation.
Figure 12:
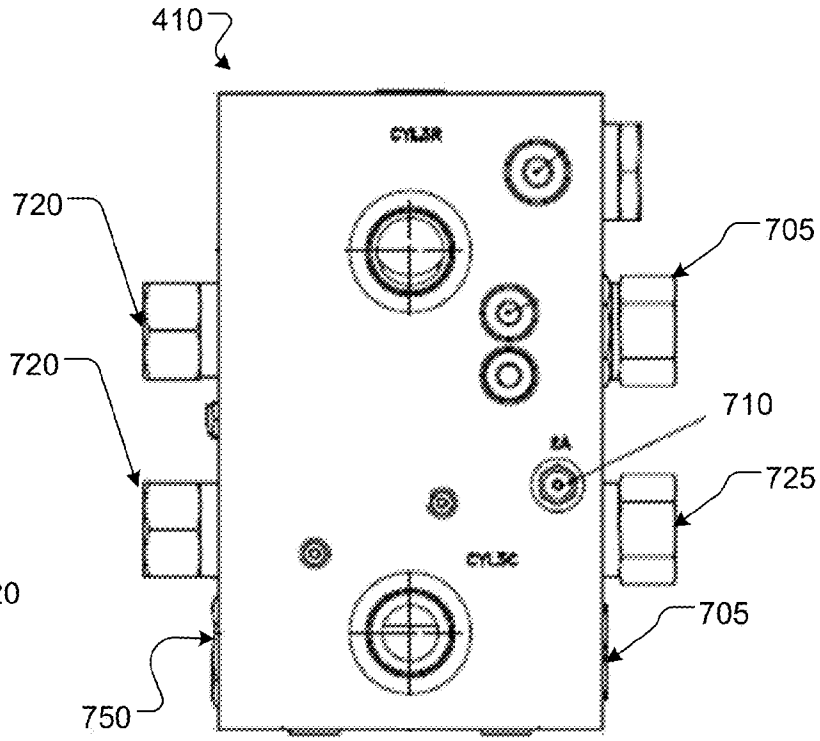
FIG. 12 is a second side view of the second valve manifold used in a boom extension system according to the example implementation.
Figure 11:
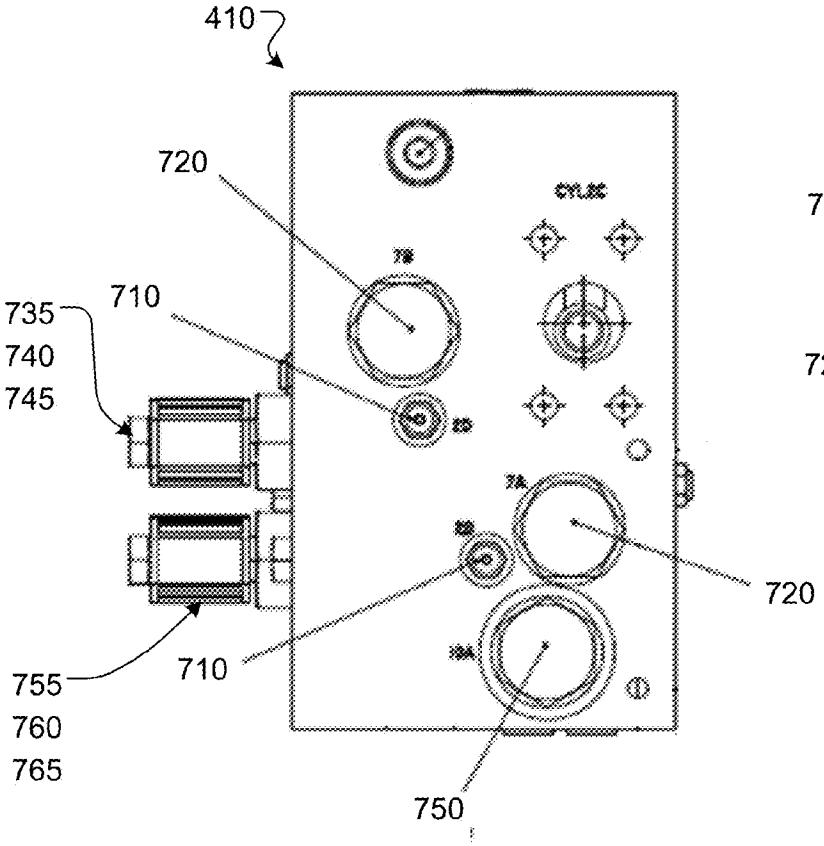
FIG. 11 is a first side view of the second valve manifold used in a boom extension system according to the example implementation.
Figure 14:
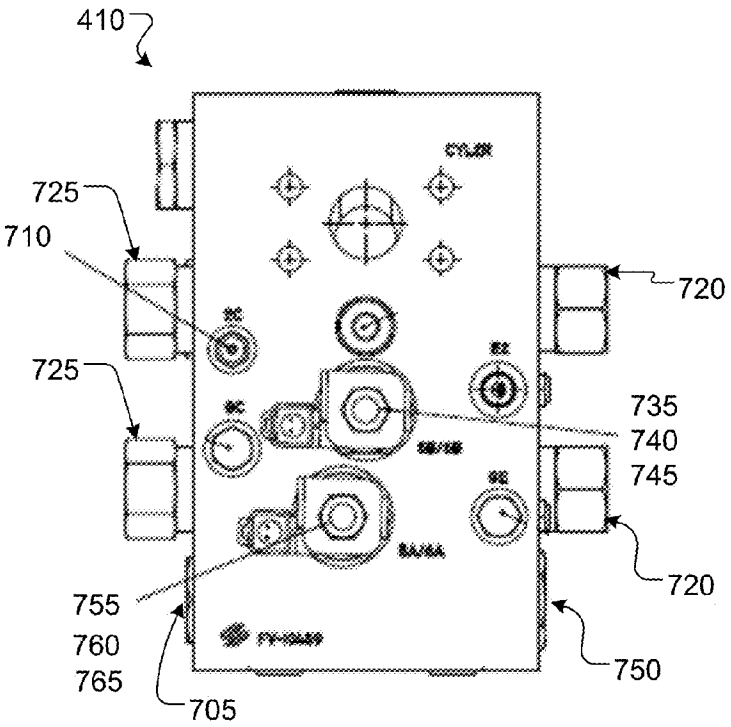
FIG. 14 is a fourth side view of the second valve manifold used in a boom extension system according to the example implementation.
Figure 13:
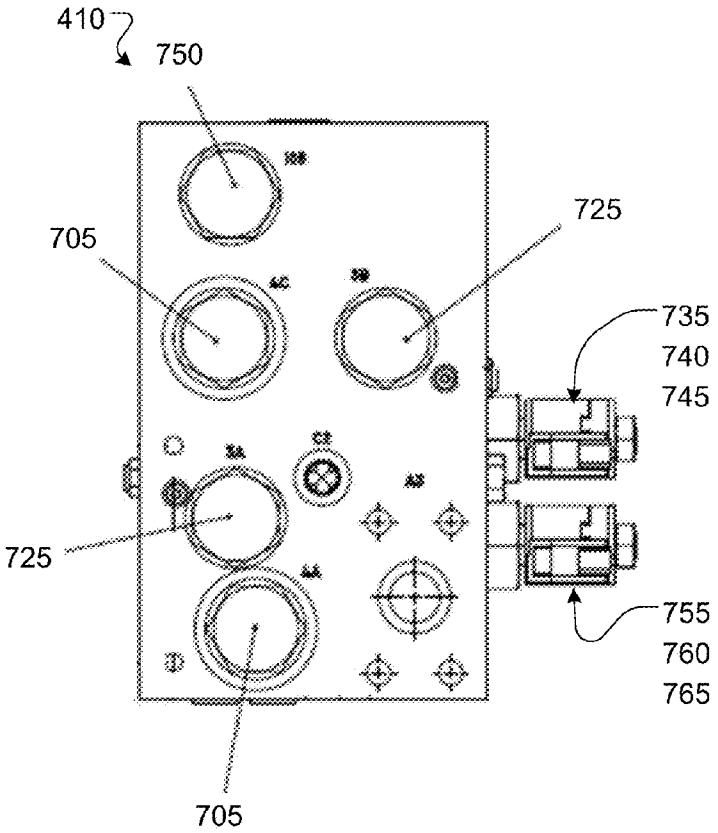
FIG. 13 is a third side view of the second valve manifold used in a boom extension system according to the example implementation.
Figure 15:
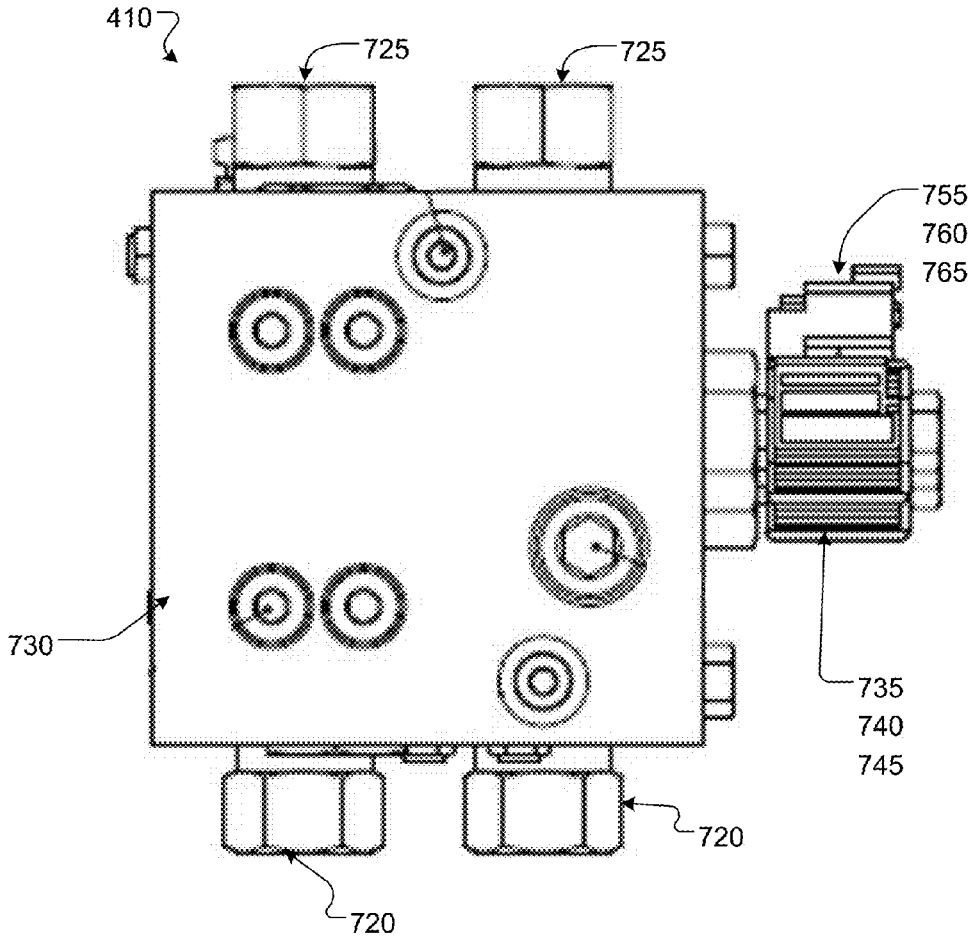
FIG. 15 is a bottom view of the second valve manifold used in a boom extension system according to the example implementation.

FIG. 1 is schematic view of a boom extension system 100 according to an example implementation. The boom extension system 100 is configured to be mounted on a piece of heavy equipment 1. The heavy equipment 1 is not particularly limited and may be any piece of heavy equipment that can accept an extendable boom. For example, and not by way of limitation, the heavy equipment may be a lifting crane, basket crane, boom lift, man lift, cherry picker, hydraladder, or any other equipment having an extendable boom as would be understood by those skilled in the art.

The heavy equipment 1 may include a base 2 on which the boom extension system 100 may be mounted, and an extended portion 3 connected to the boom extension system 100, and configured to be extended and moved by the boom extension system 100. The base 2 may be a stationary base such as a crane base platform or lower works, for example, in some example implementations. In other example implementations, the base 2 may be a mobile base such as a vehicle platform (a truck bed, for example) or trailer platform (tractor trailer platform, for example), or any other mobile platform that may be apparent to a person of ordinary skill in the art.

The extended portion 3 is not particularly limited and may include, for example, and not by way of limitation, an aerial work platform, utility bucket, manned capsule, lifting wench, pulley system, or any other structure as would be understood by those skilled in the art.

As illustrated in FIG. 1, the boom extension system 100 includes a first stage 200, a second stage 300, and a third stage 400. The first stage 200 is mounted to the base 2 of the heavy equipment 1. In some example implementations, the first stage 200 may be mounted to the base 2 so as to be rotatable or slideable relative to the base 2. In other example implementations, the first stage 200 may be mounted to the base 2 in a fixed position relative to the base 2.

The first stage 200 includes a first linear actuator 205, such as a hydraulic actuator, for example, the first linear actuator 205 is mounted to the first stage 200 at one end, and connected to the second stage 300 at an opposite end. The first stage 200 may include one or more sensors 215, 220 located at or near each end of the first linear actuator 205.

Sensor 220 may be disposed at or near the end of the first linear actuator 205 mounted to the first stage 200 and configured to sense whether the first linear actuator 205 is fully retracted, and provide a signal (e.g., feedback signal) indicative of whether the first linear actuator 205 is fully retracted to a controller 500.

Sensor 215 may be disposed at or near the end of the first linear actuator 205 connected to the second stage 300, and sense whether the first linear actuator 205 is fully extended and provide another signal (e.g., feedback signal) indicative of whether the first linear actuator 205 is fully extended to the controller 500. For example, and not by way of limitation, the sensors 215, 220 may be proximity sensors configured to provide feedback to the controller 500 based on the proximity of the ends of the first linear actuator 205 to fully extended or retracted positions.

The second stage 300 is mounted to an end of the first linear actuator 205. In some example implementations, the second stage 300 may be mounted to the first linear actuator 205 so as to be rotatable or slideable relative to the first linear actuator 205. In other example implementations, the second stage 300 may be mounted to the first linear actuator 205 in a fixed position relative to the first linear actuator 205.

The second stage 300 includes a second linear actuator 305, such as a hydraulic actuator, for example. The second linear actuator 305 is mounted to the second stage 300 at one end, and connected to the third stage 400 at an opposite end. Further, the second stage 300 may also include one or more sensors 315, 320 located at or near each end of the second linear actuator 305.

Sensor 320 may be disposed at or near the end of the second linear actuator 305 mounted to the second stage 300 and configured to sense when the second linear actuator 305 is fully retracted and provide a feedback signal to a controller 500. Sensor 315 may be disposed at or near the end of the second linear actuator 305 connected to the third stage 400 and configured to sense when the second linear actuator 305 is fully extended and provide a feedback signal to the controller 500. For example, and not by way of limitation, the sensors 315, 320 may be proximity sensors configured to provide feedback to the controller 500 based on the proximity of the ends of the second linear actuator 305 to fully extended or retracted positions.

Additionally, as illustrated, the second stage 300 also includes a first valve manifold 310 configured to control hydraulic flow to the first linear actuator 205. As discussed in greater detail below with respect to FIGS. 2-8, the first valve manifold 310 includes one or more valves and ports selectively connecting the first linear actuator 205 to a hydraulic system providing hydraulic pressure to operate the first linear actuator.

The first valve manifold 310 may be communicatively coupled to the controller 500 so as to be controlled by the controller 500. In some example implementations, the first valve manifold 310 may be electrically connected to the controller 500 by wire or a reel of cable 325. In some example implementations, the reel of cable 325 may include a self-winding or retracting mechanism 330, such as a torsion spring, configured to retract or wind the cable to remove any slack that may occur during retraction of first linear actuator.

Additionally, in some example implementations, the reel of cable 325 may include a sensor configured to measure how much cable has been unwound and provide a feedback signal to the controller 500. For example, and not by way of limitation, the sensor may be a potentiometer configured to provide a feedback signal to the controller 500 based on how much cable has been unwound from the reel of cable 325.

Example implementations need not include a physical or wireline connection between the controller 500 and the first valve manifold 310 and may alternatively include wireless communication between the controller 500 and the first valve manifold 310. For example, and not by way of limitation, the controller 500 may communicate with the first valve manifold 310 using a Bluetooth connection, WI-FI connection, Cellular connection, radio connection, or any other wireless communication connection as understood by those skilled in the art.

The third stage 400 is mounted to an end of the second linear actuator 305. In some example implementations, the third stage 400 may be mounted to the second linear actuator 305 so as to be rotatable or slideable relative to the second linear actuator 305. In other example implementations, the third stage 400 may be mounted to the second linear actuator 305 in a fixed position relative to the second linear actuator 305.

The third stage 400 includes a third linear actuator 405, such as a hydraulic actuator, for example, mounted to the third stage 400 at one end, and connected to the extended portion 3 at an opposite end. Further, the third stage 400 may also include one or more sensors 415, 420 located at or near each end of the third linear actuator 405.

Sensor 420 may be disposed at or near the end of the third linear actuator 405 mounted to the third stage 400 and configured to sense whether the third linear actuator 405 is fully retracted and provide a feedback signal to a controller 500.

Sensor 415 may be disposed at or near the end of the third linear actuator 405 connected to the extended portion 3 and configured to sense whether the third linear actuator 405 is fully extended and provide a feedback signal to the controller 500. For example, and not by way of limitation, the sensors 415, 420 may be proximity sensors configured to provide feedback to the controller 500 based on the proximity of the ends of the third linear actuator 305 to fully extended or retracted positions.

The third stage 400 also includes a second valve manifold 410 configured to control hydraulic flow to the second linear actuator 305 and the third linear actuator 405. As discussed in greater detail below with respect to FIGS. 9-15, the second valve manifold 410 includes one or more valves and ports selectively connecting the second linear actuator 305 and the third linear actuator 405 to a hydraulic system providing hydraulic pressure to operate the second linear actuator 305 and the third linear actuator 405. The second valve manifold 410 may be in communication with the controller 500 so as to be controlled by the controller 500.

In some example implementations, the second valve manifold 410 may be electrically connected to the controller 500 by wire or a reel of cable 425. In some example implementations, the reel of cable 425 may include a self-winding or retracting mechanism 430, such as a torsion spring, configured to retract or wind the cable to remove any slack that may occur during retraction of first linear actuator. Additionally, in some example implementations, the reel of cable 425 may include a sensor configured to measure how much cable has been unwound and provide a signal (e.g., feedback signal) to the controller 500. For example, and not by way of limitation, the sensor may be a potentiometer configured to provide a feedback signal to the controller 500 based on how much cable has been unwound from the reel of cable 425.

However, example implementations need not include a physical or wired connection between the controller 500 and the second valve manifold 410 and may instead feature wireless communication between the controller 500 and the second valve manifold 410. For example, and not by way of limitation, the controller 500 may communicate with the second valve manifold 410 using a Bluetooth connection, WI-FI connection, cellular connection, radio connection, or any other wireless connection that may be apparent to a person of ordinary skill in the art.

The controller 500 is not particularly limited and may be any type of controller providing a mechanism for an operator to control the first and second valve manifolds 310, 410 as understood by those skilled in the art. For example, the controller 500 may be software (e.g., instructions executable on a non-transitory computer readable medium) operating on a computer, electronic controls with or without a processor (e.g., built-in processor), or mechanical controls connected to the first and second valve manifolds 310, 410.

In some example implementations, the controller 500 may include a user interface, such as a button, switch, knob, touchscreen interface, etc. for example, to allow an operator to provide an input to control the first and second valve manifolds. Further in some implementations, the controller 500 may also include a display interface, such as CRT display, an LCD display, an LED display, a flashing light, etc. for example, to provide feedback to the operator.

Example implementations of the heavy equipment 1 and the boom extension system 100 are not limited to the specific configurations described above, and may include alternate configurations as would be apparent based on the above description.

Further, the example implementations discussed above include three stages, but example implementations are not limited to three stages and may include more or less than three stages as would be understood by those skilled in the art.

First Valve Manifold

FIGS. 2-8 provide top, side and bottom views of the first valve manifold 310 mounted on the second stage and configured to selectively connect the first linear actuator 205 to the hydraulic system. The first valve manifold 310 includes a valve housing 630, check valves 605, 610, a pressure compensated flow control valve 615, diverter valve 620, and an onboard logic element 625. Additionally, the first valve manifold 310 also includes a first solenoid valve 635, a first power coil 640, and a first plug orifice 645.

The valve housing 620 may be formed from any material and in any shape that may be apparent to a person of ordinary skill in the art to house the other components of the first valve manifold 310.

The check valves 605 may be configured to selectably direct hydraulic flow to either the diverter valve or logic element based on a desired direction of flow. The check valves 610 provide flow to or from respective common sensing lines depending on a desired direction of flow. Direction of flow is related to direction of actuator movement. However, example implementations are not limited to this configuration and alternative configurations may be apparent to a person of ordinary skill in the art.

The pressure compensated flow control valve 615 may determine the volume of flow though the common sensing line. The diverter valve 620 may be operated between open and closed positions based on the load pressure for the respective actuator and the pressure in the common sensing line to maintain a similar flow to each actuator despite differences in load pressure.

The first solenoid valve 635 may control flow of hydraulic pressure input from the hydraulic system of the heavy equipment 1 through the first plug orifice 645 to the first linear actuator 205 by blocking the flow when in a closed state and permitting flow when in an opened state. The position of the solenoid valve is determined by a control signal from the controller 500.

The volume of flow across the plug orifice 645 may determine the relative pressure drop. The logic element 625 may be operated between open or closed positions based on the pressure drop across the plug orifice 645 and the pressure in the common sensing line to maintain a similar flow from each actuator despite differences in load pressure. Additionally, the controller 500 may also control the first power coils 640 to open or close the first solenoid valve 635 and permit flow of hydraulic oil from or to the first linear actuators 205 (the second linear actuator 305, for example).

Example implementations of the first valve manifold are not limited to the specific configurations described above, and may adopt alternate configurations as may be apparent based on the above description.

Second Valve Manifold

FIGS. 9-15 provide top, side and bottom views of the second valve manifold 410 mounted on the third stage and configured to selectively connect the second and third linear actuators 305, 405 to the hydraulic system. The second valve manifold 410 includes a valve housing 730, check valves 705, 710, 750, diverter valves 720, and onboard logic elements 725. Additionally, the second valve manifold 410 also includes a second solenoid valve 735, a second power coil 740, and a second plug orifice 745. The second valve manifold 410 also includes a third solenoid valve 755, a third power coil 760, and a third plug orifice 765.

The valve housing 720 may be formed from any material and in any shape that may be apparent to a person of ordinary skill in the art to house the other components of the second valve manifold 410.

The check valves 705 and 750 may be configured to selectively direct hydraulic flow to either the diverter valve or logic element based on a desired direction of flow. The check valves 710 provide flow to or from the respective common sensing line depending on the desired direction of flow. Direction of flow is related to direction of actuator movement. However, example implementations are not limited to this configuration and alternative configurations may be apparent to a person of ordinary skill in the art.

The diverter valves 720 may be operated between open and closed positions based on the load pressure for the respective actuator and the pressure in the common sensing line to maintain a similar flow to each actuator despite differences in load pressure.

The second plug orifice 745 may connect the second valve manifold 410 to the second linear actuator 305 via a hose or tube. Further, the second solenoid valve 735 may control flow of hydraulic pressure input from the first valve manifold 310 through the second plug orifice 745 to the second linear actuator 205 by blocking the flow when in a closed state, and permitting flow when in an opened state. The position of the solenoid valve 735 is determined by a control signal from the controller 500.

The third plug orifice 765 may connect the second valve manifold 410 to the third linear actuator 405 via a hose or tube. Further, the third solenoid valve 755 may control flow of hydraulic pressure input from the first valve manifold 310 through the third plug orifice 765 to the third linear actuator 405 by blocking the flow when in a closed state and permitting flow when in an opened state. The position of the solenoid valve 755 is determined by a control signal from the controller 500.

The volume of flow across the plug orifice 745 determines the relative pressure drop. The logic element 725 modulates open or closed based on the pressure drop across plug orifice 745 and the pressure in the common sensing line to maintain a similar flow from each actuator despite differences in load pressure.

Additionally, the controller 500 may also control the second and third power coils 740, 760 to open one of the solenoid valves (the second solenoid valve 735, for example) and close the other solenoid valve (the third solenoid valve 755, for example) and permit flow of hydraulic oil from or to only one of the second and third linear actuators 305, 405 (the second linear actuator 305, for example).

Example implementations of the second valve manifold are not limited to the specific configurations described above, and may adopt alternate configurations based on the above description.

Control and Feedback Processes

Figure 16:
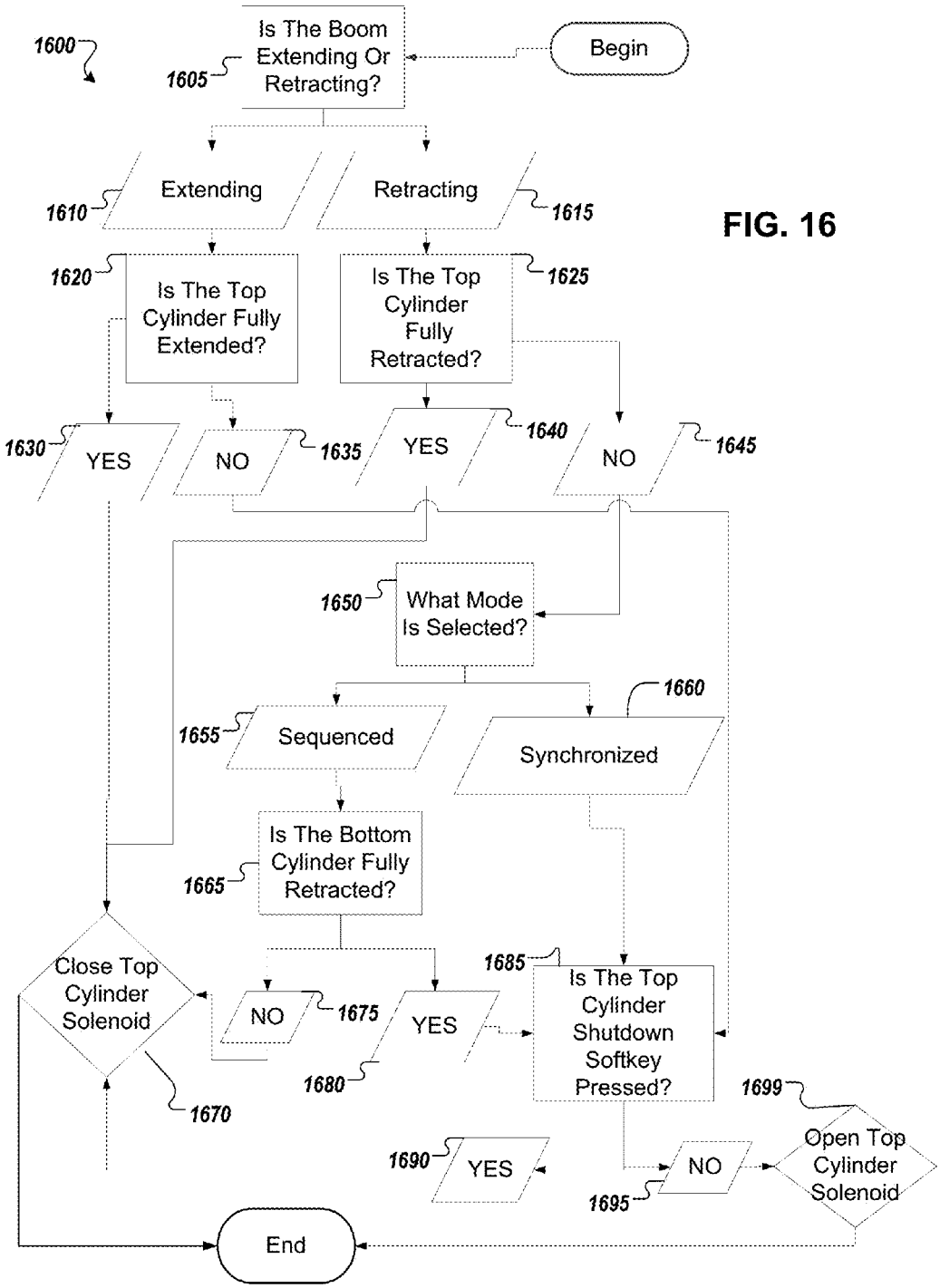
FIG. 16 is a flow chart showing a control process for a first linear actuator in a boom extension system according to the example implementation.

FIG. 16 is a flow chart showing a control process 1600 for a first linear actuator 205 in a boom extension system 100 according to the example implementation. In this example implementation, the first linear actuator 205 is a hydraulic actuator having a cylinder that may be extended and retracted. Further, in this example implementation, the first linear actuator 205 may also be referred to as the top actuator or the top cylinder 205 in the following description.

The process of 1600 may be performed by the controller 500 during the operation of the boom system 100. The process 1600 begins at 1605 where the controller 500 determines whether the boom system 100 is in an extending operation or a retracting operation, e.g. based on the direction of movement. If the controller 500 determines that the boom system is in an extending operation (1610), the controller 500 determines whether the top cylinder 205 is fully extended in 1620. If the controller 500 determines that the top cylinder is not fully extended (1635), the controller 500 determines whether a top cylinder shutdown input control, such as a softkey on a display, has been activated or pressed by an operator in 1685. If the controller 500 determines that the top cylinder shutdown input control is not activated (1695), the controller 500 opens the first solenoid valve 635 and hydraulic pressure is allowed to flow into the top cylinder 205 in 1699 and the top cylinder 205 is extended and process 1600 ends.

If the controller 500 determines that the top cylinder shutdown input control is activated (1690), the controller 500 closes the first solenoid valve 635 and flow into the top cylinder 205 is blocked and the top cylinder 205 is held at a fixed length in 1670 and process 1600 ends.

Returning to 1620, if the controller 500 determines that the top cylinder 205 is fully extended (1630), the controller 500 closes the first solenoid valve 635 and flow into the top cylinder 205 is blocked and the top cylinder 205 is held at a fixed length in 1670 and process 1600 ends.

Returning to 1605, if the controller 500 determined that the boom system 100 is in a retracting operation (1615), the controller 500 determines whether the top cylinder 205 is fully retracted in 1625 e.g., by one or more of the above-described sensor operations. If the controller 500 determines that the top cylinder 205 is fully retracted (1640), the controller 500 closes the first solenoid valve 635 and flow out of the top cylinder 205 is blocked and the top cylinder 205 is held at a fixed length in 1670 and process 1600 ends.

If in 1625, the controller 500 determines that top cylinder 205 is not fully retracted (1645), the controller 500 determines whether a sequenced mode or a synchronized mode has been selected by the operator in 1650. If the controller 500 determines that a synchronized mode (1660) has been selected, the controller 500 determines whether a top cylinder shutdown input control, such as a softkey on a display, has been activated or pressed by an operator in 1685. If the controller 500 determines that the top cylinder shutdown input control is not activated (1695), the controller 500 opens the first solenoid valve 635 and hydraulic pressure is allowed to flow out of the top cylinder 205 in 1699 and the top cylinder 205 is retracted and process 1600 ends.

If the controller 500 determines that the top cylinder shutdown input control is activated (1690), the controller 500 closes the first solenoid valve 635 and flow out of the top cylinder 205 is blocked and the top cylinder 205 is held at a fixed length in 1670 and process 1600 ends.

Returning to 1650, if the controller 500 determines that a sequenced mode (1655) has been selected, the controller 500 determines whether the bottom cylinder (i.e. the third linear actuator 405) is fully retracted in 1665. If the controller 500 determines that the bottom cylinder (i.e. the third linear actuator 405) is fully retracted (1680), the controller 500 determines whether a top cylinder shutdown input control, such as a softkey on a display, has been activated or pressed by an operator in 1685. If the controller 500 determines that the top cylinder shutdown input control is not activated (1695), the controller 500 opens the first solenoid valve 635 and hydraulic pressure is allowed to flow out of the top cylinder 205 in 1699 and the top cylinder 205 is retracted and process 1600 ends.

If the controller 500 determines that the top cylinder shutdown input control is activated (1690), the controller 500 closes the first solenoid valve 635 and flow out of the top cylinder 205 is blocked and the top cylinder 205 is held at a fixed length in 1670 and process 1600 ends.

Returning to 1665, if in 1665, the controller 500 determines that the bottom cylinder (i.e. the third linear actuator 405 in this implementation) is not fully retracted (1675), the controller 500 closes the first solenoid valve 635 and flow out of the top cylinder 205 is blocked and the top cylinder 205 is held at a fixed length in 1670 and process 1600 ends.

Once process 1600 ends in any of the above process flow pathways, operation of the boom system may be shut down by the operator or continued by the operator. If operation of the boom system is continued, process 1600 may be repeated beginning at 1605 again, as may be apparent to a person of ordinary skill in the art.

Figure 17:
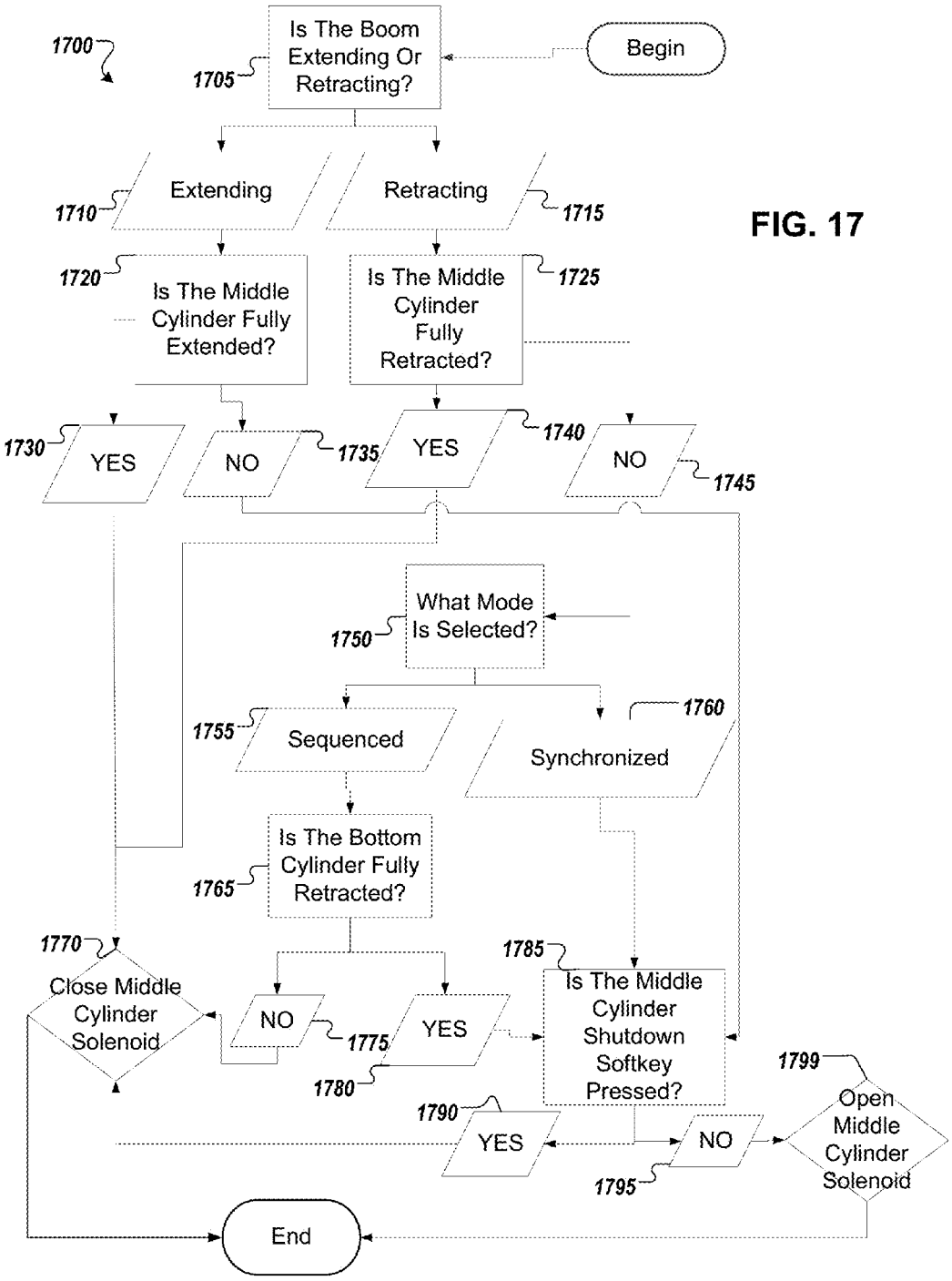
FIG. 17 is a flow chart showing a control process for a second linear actuator in a boom extension system according to the example implementation.

FIG. 17 is a flow chart showing a control process 1700 for a second linear actuator 305 in a boom extension system 100 according to the example implementation. In this example implementation, the second linear actuator 305 is a hydraulic actuator having a cylinder that may be extended and retracted. Further, the second linear actuator 305 is disposed between the first linear actuator 205 and the third linear actuator 405 and may be referred to as the middle actuator or the middle cylinder 305 in the following description.

The process of 1700 may be performed by the controller 500 during the operation of the boom system 100. The process 1700 begins at 1705 where the controller 500 determines whether the boom system 100 is in an extending operation or a retracting operation. If the controller 500 determines that the boom system is in an extending operation (1710), the controller 500 determines whether the middle cylinder 305 is fully extended in 1720. If the controller 500 determines that the middle cylinder is fully not fully extended (1735), the controller 500 determines whether a middle cylinder shutdown input control, such as a softkey on a display, has been activated or pressed by an operator in 1785.

If the controller 500 determines that the middle cylinder shutdown input control is not activated (1795), the controller 500 opens the second solenoid valve 735 and hydraulic pressure is allowed to flow into the middle cylinder 305 in 1799 and the middle cylinder 305 is extended, and process 1700 ends.

If the controller 500 determines that the middle cylinder shutdown input control is activated (1790), the controller 500 closes the second solenoid valve 735 and flow into the middle cylinder 305 is blocked and the middle cylinder 305 is held at a fixed length in 1770, and process 1700 ends.

Returning to 1720, if the controller 500 determines that the middle cylinder 305 is fully extended (1730), the controller 500 closes the second solenoid valve 735 and flow into the middle cylinder 305 is blocked and the middle cylinder 305 is held at a fixed length in 1770, and process 1700 ends.

Returning to 1705, if the controller 500 determined that the boom system 100 is in a retracting operation (1715), the controller 500 determines whether the middle cylinder 305 is fully retracted in 1725. If the controller 500 determines that the middle cylinder 305 is fully retracted (1740), the controller 500 closes the second solenoid valve 735 and flow out of the middle cylinder 305 is blocked and the middle cylinder is held at a fixed length in 1770, and process 1700 ends.

If in 1725, the controller 500 determines that middle cylinder 305 is not fully retracted (1745), the controller 500 determines whether a sequenced mode or a synchronized mode has been selected by the operator in 1750. If the controller 500 determines that a synchronized mode (1760) has been selected, the controller 500 determines whether a middle cylinder shutdown input control, such as a softkey on a display, has been activated or pressed by an operator in 1785. If the controller 500 determines that the middle cylinder shutdown input control is not activated (1795), the controller 500 opens the second solenoid valve 735 and hydraulic pressure is allowed to flow out of the middle cylinder 305 in 1799 and the middle cylinder 305 is retracted and process 1700 ends.

Conversely, if the controller 500 determines that the middle cylinder shutdown input control is activated (1790), the controller 500 closes the second solenoid valve 735 and flow out of the middle cylinder 305 is blocked and the middle cylinder 305 is held at a fixed length in 1770 and process 1700 ends.

Returning to 1750, if the controller 500 determines that a sequenced mode (1755) has been selected, the controller 500 determines whether the bottom cylinder (i.e. the third linear actuator 405) is fully retracted in 1765. If the controller 500 determines that the bottom cylinder (i.e. the third linear actuator 405) is fully retracted (1780), the controller 500 determines whether a middle cylinder shutdown input control, such as a softkey on a display, has been activated or pressed by an operator in 1785. If the controller 500 determines that the middle cylinder shutdown input control is not activated (1795), the controller 500 opens the second solenoid valve 735 and hydraulic pressure is allowed to flow out of the middle cylinder 305 in 1799 and the middle cylinder 305 is retracted and process 1700 ends.

If the controller 500 determines that the middle cylinder shutdown input control is activated (1790), the controller 500 closes the second solenoid valve 735 and flow out of the middle cylinder 305 is blocked and the middle cylinder 305 is held at a fixed length in 1770 and process 1700 ends.

Returning to 1765, if in 1765, the controller 500 determines that the bottom cylinder (i.e. the third linear actuator 405 in this implementation) is not fully retracted (1775), the controller 500 closes the second solenoid valve 735 and flow out of the middle cylinder 305 is blocked and the middle cylinder 305 is held at a fixed length in 1770, and process 1700 ends.

Once process 1700 ends in any of the above process flow pathways, operation of the boom system may be shut down by the operator or continued by the operator. If operation of the boom system is continued, process 1700 may be repeated beginning at 1705 again, as may be apparent to a person of ordinary skill in the art.

Figure 18:
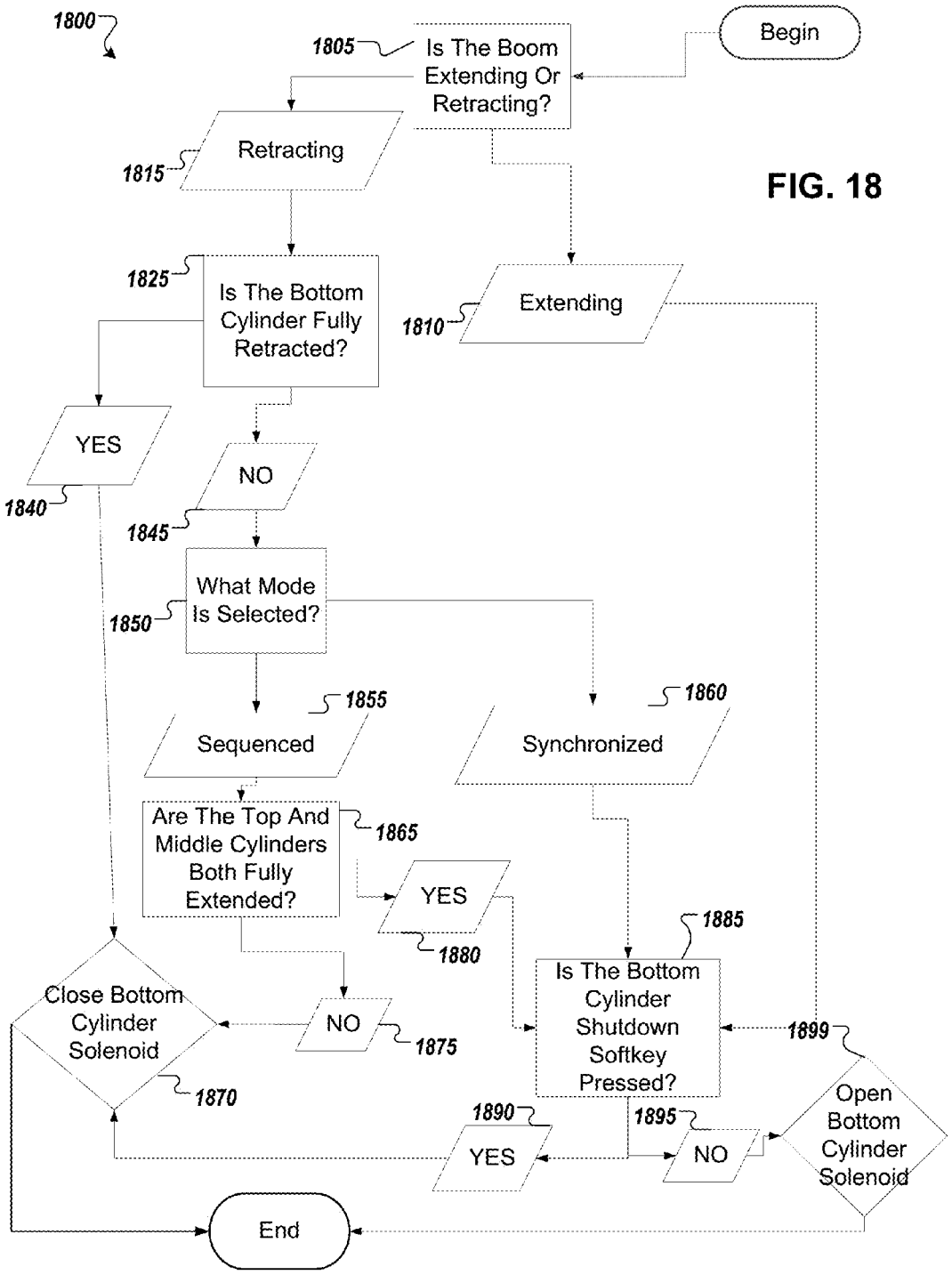
FIG. 18 is a flow chart showing a control process for a third linear actuator in a boom extension system according to the example implementation.

FIG. 18 is a flow chart showing a control process 1800 for a third linear actuator 405 in a boom extension system 100 according to the example implementation. In this example implementation, the third linear actuator 405 is a hydraulic actuator having a cylinder that may be extended and retracted. Further, in this example implementation, the third linear actuator 405 may also be referred to as the bottom actuator or the bottom cylinder 405 in the following description.

The process of 1800 may be performed by the controller 500 during the operation of the boom system 100. The process 1800 begins at 1805 where the controller 500 determines whether the boom system 100 is in an extending operation or a retracting operation, e.g., based on the direction of movement or mode selection control selected by an operator. If the controller 500 determines that the boom system is in an extending operation (1810), the controller 500 determines whether a bottom cylinder shutdown input control, such as a softkey on a display, has been activated or pressed by an operator in 1885.

If the controller 500 determines that the bottom cylinder shutdown input control is not activated (1895), the controller 500 opens the third solenoid valve 755 and hydraulic pressure is allowed to flow into the bottom cylinder 405 in 1899 and the bottom cylinder 405 is extended, and process 1800 ends.

If the controller 500 determines that the bottom cylinder shutdown input control is activated (1890), the controller 500 closes the third solenoid valve 755 and flow into the bottom cylinder 405 is blocked and the bottom cylinder 405 is held at a fixed length in 1870, and process 1800 ends.

Returning to 1805, if the controller 500 determined that the boom system 100 is in a retracting operation (1815), the controller 500 determines whether the bottom cylinder 405 is fully retracted in 1825, e.g., by one or more of the above-described sensor operations. If the controller 500 determines that the bottom cylinder 405 is fully retracted (1840), the controller 500 closes the third solenoid valve 755 and flow out of the bottom cylinder 405 is blocked and the bottom cylinder 405 is held at a fixed length in 1870 and process 1800 ends.

Conversely, if the controller 500 determines that the bottom cylinder 405 is not fully retracted (1845) in 1825, the controller 500 determines whether a sequenced mode or a synchronized mode has been selected by the operator in 1850. If the controller 500 determines that a synchronized mode (1860) has been selected, the controller 500 determines whether a bottom cylinder shutdown input control, such as a softkey on a display, has been activated or pressed by an operator in 1885. If the controller 500 determines that the bottom cylinder shutdown input control is not activated (1895), the controller 500 opens the third solenoid valve 755 and hydraulic pressure is allowed to flow out of the bottom cylinder 405 in 1899 and the bottom cylinder 405 is retracted and process 1800 ends.

Conversely, if the controller 500 determines that the bottom cylinder shutdown input control is activated (1890), the controller 500 closes the third solenoid valve 755 and flow out of the bottom cylinder 405 is blocked and the bottom cylinder 405 is held at a fixed length in 1870 and process 1800 ends.

Returning to 1850, if the controller 500 determines that a sequenced mode (1855) has been selected, the controller 500 determines whether the top cylinder (i.e. the first linear actuator 205 in this implementation) and the middle cylinder (i.e. the second linear actuator 305 in this implementation) are both fully extended in 1865. If the controller 500 determines that both the top cylinder (i.e. the first linear actuator 205 in this implementation) and the middle cylinder (i.e. the second linear actuator 305 in this implementation) are fully extended (1880), the controller 500 determines whether a bottom cylinder shutdown input control, such as a softkey on a display, has been activated or pressed by an operator in 1885.

If the controller 500 determines that the bottom cylinder shutdown input control is not activated (1895), the controller 500 opens the third solenoid valve 755 and hydraulic pressure is allowed to flow out of the bottom cylinder 405 in 1899 and the bottom cylinder 405 is retracted, and process 1800 ends.

Conversely, if the controller 500 determines that the bottom cylinder shutdown input control is activated (1890), the controller 500 closes the third solenoid valve 755 and flow out of the bottom cylinder 405 is blocked and the bottom cylinder 405 is held at a fixed length in 1870 and process 1800 ends.

Returning to 1865, if, in 1865, the controller 500 determines either the top cylinder (i.e. the first linear actuator 205 in this implementation) and/or the middle cylinder (i.e. the second linear actuator 305) are not fully extended (1875), the controller 500 closes the third solenoid valve 755 and flow out of the bottom cylinder 405 is blocked and the bottom cylinder 405 is held at a fixed length in 1870 and process 1800 ends.

Once process 1800 ends in any of the above process flow pathways, operation of the boom system may be shut down by the operator or continued by the operator. If operation of the boom system is continued, process 1800 may be repeated beginning at 1805 again, as may be apparent to a person of ordinary skill in the art.

Figure 19:
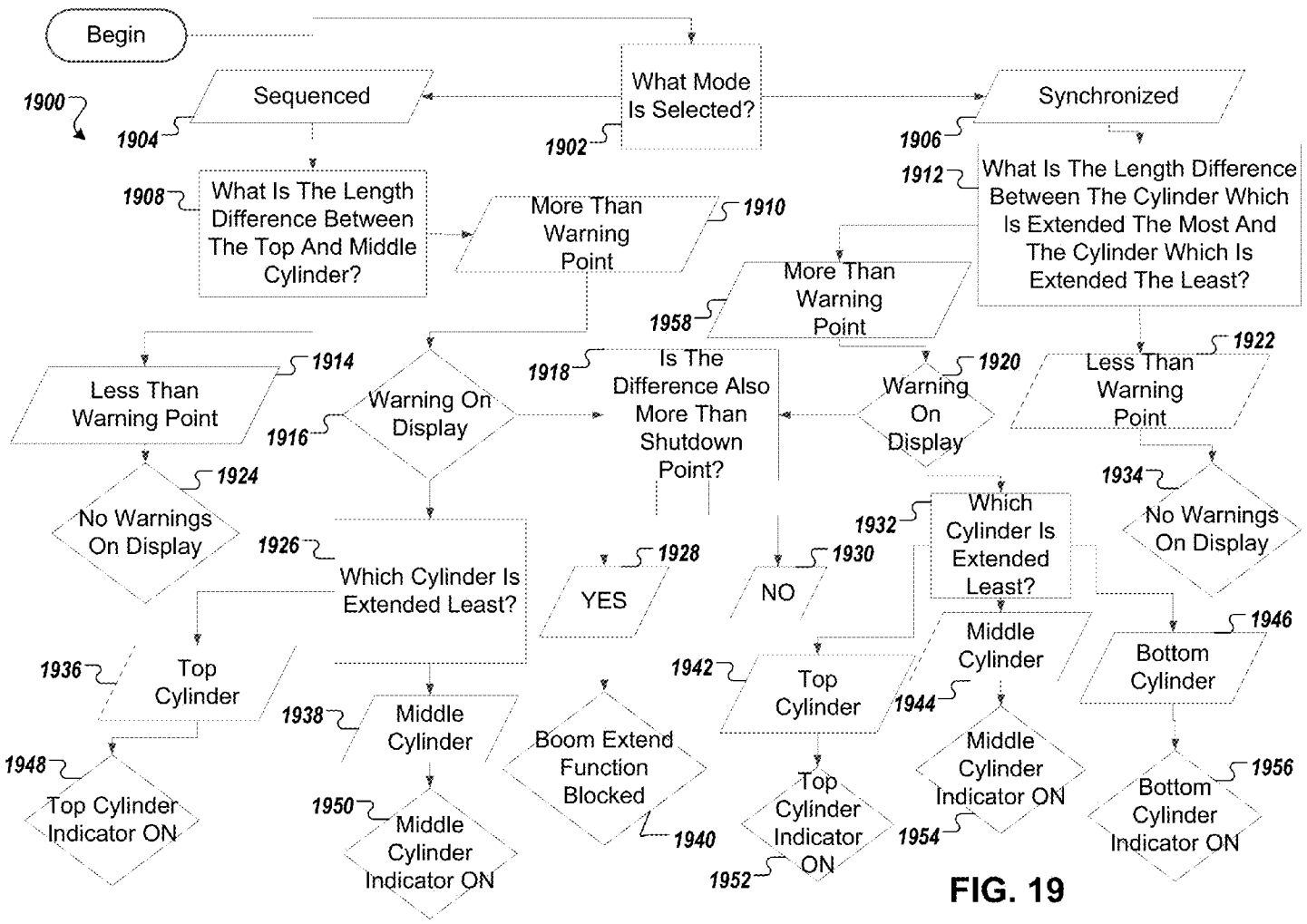
FIG. 19 is a flow chart showing a feedback process for displaying feedback for a boom extension system according to the example implementation.

FIG. 19 is a flow chart showing a feedback process 1900 for displaying feedback for a boom extension system 100 according to the example implementation. The feedback process 1900 may be performed by the controller 500 based on sensor information provided by one or more of the sensors incorporated into the boom extension system 100. For example, one or more of the proximity sensors 215, 315, 415, 220, 320, 420 and/or the sensors incorporated into the cable reels 325, 425, may provide sensor information to the controller 500. The feedback information can be displayed by the controller 500 to an operator on a display, such as a computer screen, dial gauge, digital readout, flashing light, etc. based on the provided sensor information.

In process 1900, the controller 500 determines whether the boom system 100 is operating in a sequenced mode or a synchronized mode in 1902. If the controller 500 determines that the boom system 100 is operating in a sequenced mode (1904), the controller 500 determines the difference in extended length between the top cylinder 205 and the middle cylinder 305 and compares the determined extended length difference to a warning threshold in 1908. If the controller 500 determines that the difference in extended length does not exceed the warning threshold (1914), the controller 500 does not display a warning to the operator in 1924 and process 1900 ends. In some example implementations, the controller 500 may optionally display a read out or value of the determined length difference to the operator in 1924.

If the controller 500 determines that the length difference exceeds the warning threshold (1910), the controller determines that a warning should be displayed to the operator in 1916 and determines whether the top cylinder 205 or the middle cylinder 305 is extended the least amount in 1926.

If the controller 500 determines that the top cylinder 205 is extended the least (1936), the controller 500 displays a top cylinder indicator in 1948 and process 1900 ends. Conversely, if the controller 500 determines that the middle cylinder 305 is extended the least (1938), the controller 500 displays a middle cylinder indicator in 1950 and process 1900 ends. Additionally, in some implementations the controller 500 may also, optionally, display a read out or value of the determined extended length difference to the operator in 1948, or 1950.

When the controller 500 determines that a warning should be displayed to the operator in 1916, the controller 500 may also optionally determine whether the difference in extended length of the top cylinder 205 and the middle cylinder 305 exceeds an automatic shutdown limit in 1918. If the controller 500 determines that the difference in extended length of the top cylinder 205 and the middle cylinder 305 exceeds the automatic shutdown limit (1928), the controller 500 automatically blocks the boom extend function in the current boom extension system in 1940 and process 1900 ends.

In some example implementations, operation of the boom extension system may be shut down until the operator manually retracts or extends one of the top cylinder 205 and the middle cylinder 305 such that difference in extended length of the top cylinder 205 and the middle cylinder 305 no longer exceeds the automatic shutdown limit.

If the controller 500 determines that the difference in extended length of the top cylinder 205 and the middle cylinder 305 does not exceed the automatic shutdown limit (1930), the controller 500 allows the current boom system operation to continue, and process 1900 ends.

Returning to 1902, if the controller 500 determines that the boom system 100 is operating in a synchronized mode (1906), the controller 500 determines which of the first, second, and third cylinders (205, 305, 405) is extended the least, and which of the first second and third cylinders is extended the most in 1912. Additionally, in 1912, the controller 500 also determines what is the difference in extended length between the cylinder extended the least and the cylinder extended the most and compares that determined difference to a warning threshold.

If the controller 500 determines that the difference in extended length does not exceed the warning threshold (1922), the controller 500 does not display a warning to the operator 1934 and process 1900 ends. Additionally, in some implementations the controller 500 may also, optionally, display a read out or value of the determined extended length difference to the operator in 1934.

If the controller 500 determines that the extended length difference exceeds the warning threshold (1958), the controller determines that a warning should be displayed to the operator in 1920 and determines whether the top cylinder 205, the middle cylinder 305, or bottom cylinder 405 is extended the least amount in 1932. If the controller 500 determines that the top cylinder 205 is extended the least (1942), the controller 500 displays a top cylinder indicator in 1952 and process 1900 ends. If the controller 500 determines that the middle cylinder 305 is extended the least (1944), the controller 500 displays a middle cylinder indicator in 1954 and process 1900 ends.

If the controller 500 determines that the bottom cylinder 405 is extended the least (1946), the controller 500 displays a bottom cylinder indicator in 1956 and process 1900 ends. Additionally, in some implementations the controller 500 may also, optionally, display a read out or value of the determined extended length difference to the operator in 1952, 1954, or 1956.

When the controller 500 determines that a warning should be displayed to the operator in 1920, the controller 500 may also optionally determine whether the difference in extended length between the cylinder extended the most and the cylinder extended the least exceeds an automatic shutdown limit in 1918. If the controller 500 determines that the difference in extended length between the cylinder extended the most and the cylinder extended the least exceeds the automatic shutdown limit (1928), the controller 500 automatically blocks the boom extend function of the current boom extension system in 1940 and process 1900 ends. In some implementations, operation of the boom extension system may be shut down until the operator manually retracts or extends one or more of the top cylinder 205, middle cylinder 305 and the bottom cylinder 405 such that difference in extended length between the cylinder extended the most and the cylinder extended the least no longer exceeds the automatic shutdown limit.

If the controller 500 determines that the difference in extended length between the cylinder extended the most and the cylinder extended the least does not exceed the automatic shutdown limit (1930), the controller 500 allows the current boom system operation to continue and process 1900 ends.

Once process 1900 ends in any of the above process flow pathways, operation of the boom system may be shut down by the operator or continued by the operator. If operation of the boom system is continued, process 1900 may be repeated beginning at 1902 again, as may be apparent to a person of ordinary skill in the art.

The foregoing detailed description has set forth various example implementations of the devices and/or processes via the use of block diagrams, schematics, and examples. Insofar as such block diagrams, schematics, and examples contain one or more functions and/or operations, each function and/or operation within such block diagrams, flowcharts, or examples can be implemented, individually and/or collectively, by a wide range of hardware.

While certain example implementations have been described, these example implementations have been presented by way of example only, and are not intended to limit the scope of the protection. Indeed, the novel apparatuses described herein may be embodied in a variety of other forms. Furthermore, various omissions, substitutions and changes in the form of the systems described herein may be made without departing from the spirit of the protection. The accompanying claims and their equivalents are intended to cover such forms or modifications as would fall within the scope and spirit of the protection.

What is claimed is:

1. An extension boom system for heavy equipment having a base, the extension boom system comprising:

a first actuator mounted on the base, and connecting the base to a second stage;

a second actuator mounted on the second stage and connecting the second stage to a third stage;

a third actuator mounted on the third stage and connecting the third stage to an extendable portion;

a sensor configured to measure an extension of at least one of the first actuator, the second actuator, and the third actuator; and a controller configured to control the first actuator, the second actuator, and the third actuator so as to selectively operate in a first operation mode and a second operation mode;

wherein in the first operation mode, the first actuator, the second actuator, and the third actuator are operated substantially simultaneously; and in the first operation mode the sensor measures an extension difference between one of the first actuator, the second actuator, and the third actuator having the greatest extension and another one of the first actuator, the second actuator and the third actuator having the least extension, and the controller blocks further extension when the extension difference measured exceeds a threshold; and wherein in the second operation mode, two of the first actuator, the second actuator, and the third actuator are actuated substantially simultaneously, while another of the first actuator, the second actuator, and the third actuator is not actuated; and in the second operation mode the sensor measures an extension difference between the first actuator and the second actuator, and the controller blocks further extension when the extension difference measured exceeds a threshold.

2. The extension boom system of claim 1, wherein at least one of the first actuator, the second actuator, and the third actuator is a hydraulic actuator.

3. The extension boom system of claim 1, wherein the sensor further comprises at least one sensor mounted at or near one of the first actuator, the second actuator, and the third actuator, and configured to detect whether the one of the first actuator, the second actuator, and the third actuator is fully retracted.

4. The extension boom system of claim 1, wherein the sensor further comprises at least one sensor mounted to one of the first actuator, the second actuator, and the third actuator, and configured to detect whether the one of the first actuator, the second actuator, and the third actuator is fully extended.

5. The extension boom system of claim 1, wherein a retracting cable reel is mounted on the extension boom system, the retracting cable reel comprising a cable connecting the controller to at least one of the first actuator the second actuator, and the third actuator; and a self-winding structure that retracts the cable to take up any slack of the cable.

6. The extension boom system of claim 5, wherein the retracting cable reel further comprises a sensor configured to sense a length of extension of the cable during operation of the extension boom system.

7. A piece of heavy equipment comprising:

a base;

an extendable structure;

an extension boom system connecting the base structure to the extendable structure, the extension boom system comprising:

a first actuator mounted on the base, and connecting the base to a second stage;

a second actuator mounted on the second stage and connecting the second stage to a third stage;

a third actuator mounted on the third stage and connecting the third stage to an extendable structure;

a sensor configured to measure an extension of at least one of the first actuator, the second actuator, and the third actuator; and a controller configured to control the first actuator, the second actuator, and the third actuator to as to selectively operate in a first operation mode and a second operation mode;

wherein in the first operation mode, the first actuator, the second actuator, and the third actuator are operated substantially simultaneously; and in the first operation mode the sensor measures an extension difference between one of the first actuator, the second actuator, and the third actuator having the greatest extension and another one of the first actuator, the second actuator and the third actuator having the least extension, and the controller blocks further extension when the extension difference measured exceeds a threshold; and wherein in the second operation mode, two of the first actuator, the second actuator, and the third actuator are actuated substantially simultaneously, while another of the first actuator, the second actuator, and the third actuator is not actuated; and in the second operation mode the sensor measures an extension difference between the first actuator and the second actuator, and the controller blocks further extension when the extension difference measured exceeds a threshold.

8. The piece of heavy equipment of claim 7, wherein at least one of the first actuator, the second actuator, and the third actuator is a hydraulic actuator.

9. The piece of heavy equipment of claim 7, wherein the sensor further comprises at least one sensor mounted at or near one of the first actuator, the second actuator, and the third actuator, and configured to detect whether the one of the first actuator, the second actuator, and the third actuator is fully retracted.

10. The piece of heavy equipment of claim 7, wherein the sensor further comprises at least one sensor mounted to one of the first actuator, the second actuator, and the third actuator, and configured to detect whether the one of the first actuator, the second actuator, and the third actuator is fully extended.

11. The piece of heavy equipment of claim 7, wherein a retracting cable reel is mounted on the extension boom system, the retracting cable reel comprising a cable connecting the controller to at least one of the first actuator, the second actuator, and the third actuator;

a self-winding structure that retracts the cable to take up any slack of the cable.

12. The piece of heavy equipment of claim 7, wherein the retracting cable reel further comprises a sensor configured to sense a length of extension of the cable during operation of the extension boom system.

13. A method for controlling an extension boom system including a first actuator connecting to a secondary stage, a second actuator mounted on the secondary stage and connecting to a tertiary stage, and a third actuator mounted on the tertiary stage and connecting to an extendable portion, the method comprising:

selecting one of a first operation mode and a second operation mode;

when the first operation mode is selected:

actuating each of the first actuator, the second actuator, and the third actuator substantially simultaneously to extend or retract the extension boom system;

measuring an extension difference between one of the first actuator, the second actuator, and the third actuator having the greatest extension and another one of the first actuator, the second actuator and the third actuator having the least extension; and blocking further extension when the extension difference measured exceeds a threshold; and when the second operation mode is selected:

actuating only two of the first actuator, the second actuator, and the third actuator simultaneously;

after the two of the first actuator, the second actuator, and the third actuator are actuated simultaneously, actuating only the other of the first actuator, the second actuator, and the third actuator;

measuring an extension difference between the first actuator and the second actuator; and blocking further extension when the extension difference measured exceeds a threshold.

14. The method of claim 13, further comprising:

detecting, by a sensor, whether one of the first actuator, the second actuator, and the third actuator is fully retracted.

15. The method of claim 13, further comprising:

detecting, by a sensor, whether one of the first actuator, the second actuator, and the third actuator is fully extended.

16. The method of claim 13, wherein the extension boom system includes a retracting cable reel comprising a cable connecting to at least one of the first actuator, the second actuator, and the third actuator and a self-winding structure that retracts the cable to take up any slack of the cable;

wherein the method further comprises sensing, by a sensor, a length of extension of the cable during operation of the extension boom system.

* * * * *